United States Patent [19]

Hsu

[11] 4,207,148

[45] Jun. 10, 1980

[54] ELECTROPLATING BATH FOR THE ELECTRODEPOSITION OF TIN AND TIN/CADMIUM DEPOSITS

[75] Inventor: Grace F. Hsu, Somers, Conn.

[73] Assignee: Minnesota Mining and Manufacturing Company, Saint Paul, Minn.

[21] Appl. No.: 12,806

[22] Filed: Feb. 16, 1979

Related U.S. Application Data

[63] Continuation of Ser. No. 890,925, Mar. 28, 1978, abandoned, which is a continuation of Ser. No. 748,938, Dec. 9, 1976, abandoned, which is a continuation of Ser. No. 636,068, Nov. 28, 1975, abandoned.

[51] Int. Cl.[2] ..... C25D 3/32; C25D 3/56; C25D 3/60

[52] U.S. Cl. ..... 204/43 S; 204/43 R; 204/54 R

[58] Field of Search ..... 204/54 R, 50 R, 43 R, 204/43 S

[56] References Cited

U.S. PATENT DOCUMENTS

| | | | |
|---|---|---|---|
| 2,315,802 | 4/1943 | Lind et al. | 204/49 |
| 3,361,652 | 1/1968 | Korpiun et al. | 204/54 R |
| 3,471,379 | 10/1969 | Schoot et al. | 204/54 R |
| 3,616,306 | 10/1971 | Conoby et al. | 204/54 R |
| 3,769,182 | 10/1973 | Hsu | 204/43 S |
| 3,875,029 | 4/1975 | Rosenberg et al. | 204/43 S |
| 3,956,123 | 5/1976 | Rosenberg et al. | 204/54 R |

*Primary Examiner*—G. L. Kaplan

*Attorney, Agent, or Firm*—Cruzan Alexander; Donald M. Sell; Gerald F. Chernivec

[57] ABSTRACT

An acidic electroplating bath for providing a bright tin or tin/cadmium deposit containing stannous ions or mixtures of stannous and cadmium ions, a free acid, a non-ionic surfactant and as a brightener system a ring-halogenated aryl aldehyde, formaldehyde, and at least one compound of the formula:

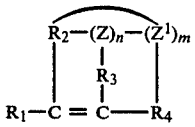

where n and m are zero or 1, and when n is 1, m is zero and when m is 1, n is zero, $R_1$ is hydrogen or a lower alkyl group, and when both m and n are zero, $R_2$ and $R_3$ are hydrogen or lower alkyl groups and $R_4$ is a formyl, alkyl carbonyl, carboxamido, or carboxy group or mixtures thereof, and when $R_4$ is a formyl or alkyl carbonyl group or mixtures thereof, $R_1$ or $R_2$ is a lower alkyl group; when n is 1, the combination of $R_2$ and Z represent ethenylene and $R_3$ is an oxygen or sulfur radical, and $R_4$ is as above; when m is 1, the combination of $R_2$ and $Z^1$ represent alkylene, $R_3$ is hydrogen or a lower alkyl group and $R_4$ is a carbonyl group.

Alternatively, the formaldehyde can be deleted and an aldehyde or ketone can be used in conjunction with a carboxylic acid or an amide, both as above defined.

6 Claims, No Drawings

ELECTROPLATING BATH FOR THE ELECTRODEPOSITION OF TIN AND TIN/CADMIUM DEPOSITS

This is a continuation of application Ser. No. 890,925, filed Mar. 28, 1978, which in turn was a continuation of application Ser. No. 748,938, filed Dec. 9, 1976, which in turn was a continuation of application Ser. No. 636,068, filed Nov. 28, 1975, all now abandoned.

BACKGROUND OF THE INVENTION

A variety of electroplating baths have been disclosed for the electrodeposition of bright tin upon metallic substrates. These baths have been substantially acidic and have been utilized in many industrial applications. Typical of such disclosed baths include those described in U.S. Pat. Nos. 3,361,652; 3,471,379 and 3,875,029.

Many of these aforementioned baths contain as surface active agents imidazoline derivatives, which tend to provide instability to the bath. Furthermore, the baths aforementioned typically contain a single carbonyl compound as a brightener. While these baths have proven generally satisfactory, and have been widely utilized in a commercial setting, they are usually deficient in one or more desirable operating characteristics, and the deposits produced thereby frequently fail to provide a balance of characteristics such as smoothness, brightness, adherence, solderability and stability to resist aging. Furthermore, these baths typically do not exhibit the aforementioned characteristics over the entire operable range of current densities and do not avoid step plating and shadowing when holes and deep recessed areas are present in the metallic work piece utilized in the bath.

Therefore, while various of the baths described in the literature are operable with varying degrees of effectiveness, there has remained a need to provide a bath capable of producing smooth adherent deposits exhibiting spectral brightness over a wide current density range and wherein the components of the bath provide substantial stability thereto.

It has now been determined that by utilizing a specifically defined combination of organic brighteners, an acid tin or tin-cadmium alloy electroplating bath is provided which is substantially stable and is capable of producing bright, smooth, fine-grained deposits over a wide cathode current density range upon continued electrolysis. Furthermore, superior bright throwing power in recessed areas of the cathode is exhibited. Since the bath is free of ammonium ion and cyanide/or chelating compounds, simplification of waste treatment procedures necessary for removal of the metals from the bath is exhibited.

SUMMARY OF THE INVENTION

In accordance with the invention, there is provided an aqueous acidic bath for the electrodeposition of tin or tin/cadmium comprising from about 7.5 to about 75 grams per liter of stannous or a mixture of stannous and cadmium ions, from about 70 to about 400 grams per liter of a free acid selected from the group consisting of sulfuric acid, fluoboric acid or mixtures thereof, from about 3 to about 30 grams per liter of a non-ionic polyoxyalkylated surfactant and a brightener combination consisting of from about 0.01 to about 0.5 gram per liter of a ring-halogenated aryl aldehyde, from about 2 to about 30 milliliters per liter of an aqueous formaldehyde solution and about 0.1 to about 2.0 grams per liter of at least one compound of the formula:

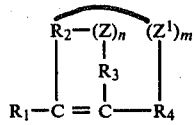

I wherein n is zero or 1, m is zero or 1 and when n is 1, m is zero and when m is 1, n is zero, $R_1$ is hydrogen or a lower alkyl group and when n and m are zero, $R_2$ and $R_3$ are hydrogen or lower alkyl groups and $R_4$ is a formyl, alkyl carbonyl, carboxamido, or carboxy group or mixture thereof, and when $R_4$ is a formyl or alkyl carbonyl group or a mixture thereof, $R_1$ or $R_2$ is a lower alkyl group; when n is 1, the combination of $R_2$ and Z represent ethenylene, $R_3$ is an oxygen or sulfur radical, and $R_4$ is a formyl, alkyl carbonyl, carboxamido, or carboxy group or mixture thereof; when m is 1, the combination of $R_2$ and $Z^1$ represent alkylene, $R_3$ is hydrogen or a lower alkyl group, and $R_4$ is a carbonyl group.

A second brightener combination useful herein consists of from about 0.01 to about 0.5 grams per liter of a ring-halogenated aryl aldehyde, about 0.1 to about 2.0 grams per liter of a compound defined by the above formula wherein m is zero and $R_4$ is formyl or alkyl carbonyl group or mixture thereof, and from about 0.1 to about 2.0 grams per liter of a compound defined by the above formula wherein m is zero and $R_4$ is a carboxamido or carboxy group or mixture thereof. Such can be represented by the formula:

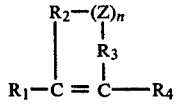

II wherein n, $R_1$, $R_2$ and $R_3$ are as shown above.

By utilizing one of these brightener combinations, bright tin or tin/cadmium deposits can be obtained over a wide current density range upon continued operation of the bath.

DETAILED DESCRIPTION OF THE INVENTION

The acid bath of the present invention requires stannous ions or mixtures of the stannous and cadmium ions, a free acid selected from the group consisting of sulfuric, fluoboric or mixtures thereof, a non-ionic polyoxyalkylated surfactant, and a specific combination of organic brighteners as defined herein below.

Typically, the bath may contain from about 7.5 to about 75 grams per liter of stannous ion or a mixture of stannous and cadmium ions furnished individually as soluble salts such as stannous sulphate, stannous fluoborate, cadmium sulphate, cadmium fluoborate or materials such as cadmium oxide which are capable of forming a metallic salt with anions normally introduced with the bath. Metallic ion concentrations greater than about 75 grams per liter may tend to produce coarse, grainy and dull deposits at low cathode current density areas, i.e. less than about 0.5 amperes per square decimeter. Metal ion concentrations lower than about 7.5 grams per liter may tend to provide low cathode current efficiency to the bath and burning and pitting of the cathode at high cathode current density areas. Preferably, the bath contains from about 12.0 to about 40.0 grams per liter of metallic ion.

The free acid concentration may range from about 70 to about 400 grams per liter with from about 100 to about 200 grams per liter being preferred. At concentrations of less than about 70 grams per liter, the bath may exhibit poor conductivity and therefore be operative only a narrow range of current densities producing coatings of marginal quality. Increasing the acid concentration beyond about 400 grams per liter produces a minimal additional increase in current density and tends to reduce the cathode current efficiency.

As to the non-ionic surfactant, virtually any surface active polyoxyalkylated compound which is soluble in the bath may be employed, and a wide variety of such materials are commercially available under a number of different tradenames. However, it has been found that the polyethoxylated fatty acid monoalkylolamides and the polyeth oxylated alkyl phenols have performed particularly effectively in the baths of the invention. Exemplary of the polyethoxylated fatty acid monoethanolamides that are advantageously used in the bath are the coconut fatty acid and lauric acid derivatives which are commercially available from the Stepan Chemical Company under the tradenames Amidox C-5 and Amidox L-5, respectively. Exemplary of a polyethoxylated alkyl phenol surfactant is the ethoxylated nonyl phenol derivative commercially available from the Millmaster Onyx Corporation under the tradename Neutronyx 656.

Substitution of similar surfactants for those enumerated above is contemplated and encompassed within the scope of the invention herein, and specific alternative non-ionic surfactants will be apparent to those skilled in the art in view of the disclosure herein.

The surfactant concentration may range from about 3 to about 30 grams per liter with from about 4 to about 15 grams per liter being preferred. Utilization of less than about 3 grams per liter may tend to produce a thin deposit, especially at low current density areas, i.e. less than about 1.0 ampere per square decimeter. At surfactant concentrations greater than about 30 grams per liter, little additional benefit is gained and the deposit may tend to be dull at low current density areas.

It has been determined that a specific combination of organic brighteners, in conjunction with the non-ionic surfactant defined above, are capable of providing bright specular deposits over the entire useful cathode current density range, i.e. from about 0.02 to about 25 amperes per square decimeter. There are in essence two combinations of brighteners which have been found to function satisfactorily to provide the aforementioned characteristics to the tin or tin/cadmium plate. The first brightener combination contains therein a ring-halogenated aryl aldehyde, formaldehyde and at least one compound of the formula:

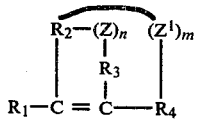

wherein n is zero or 1, m is zero or 1, and when n is 1, m is zero and when m is 1, n is zero, $R_1$ is hydrogen or a lower alkyl group, and when n and m are zero, $R_2$ and $R_3$ are hydrogen or lower alkyl groups and $R_4$ is a formyl (i.e. OCH—), alkyl carbonyl (i.e. RCO—), carboxamido (i.e. $R_2NCO$—), or carboxy (i.e. HOOC—) group or mixture thereof, and when $R_4$ is a formyl or alkyl carbonyl group or a mixture thereof, $R_1$ or $R_2$ is a lower alkyl group; such can be depicted:

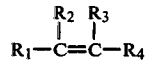

when n is 1, the combination of $R_2$ and Z represent ethenylene (i.e. —CH=CH—), $R_3$ is an oxygen or sulfur radical, and $R_4$ is a formyl, alkyl carbonyl, carboxamido, or carboxy group or mixture thereof; such can be depicted:

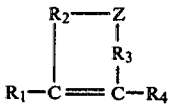

when m is 1, the combination of $R_2$ and $Z^1$ represent alkylene, (i.e. —R—), $R_3$ is hydrogen or a lower alkyl group, and $R_4$ is a carbonyl group, (i.e. OC=); such can be represented:

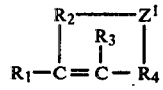

By the term "lower alkyl group" is meant an alkyl group of less than 4 carbon atoms.

Examples of ring-halogenated aryl aldehydes include ortho-chlorobenzaldehyde, para-chlorobenzaldehyde, 2,4-dichlorobenzaldehyde and 2,6-dichlorobenzaldehyde.

Exemplary compounds falling under the scope of Formula I when both m and n are zero, i.e. non-cyclic compounds, include:

mesityl oxide

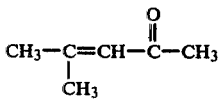

croton aldehyde

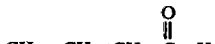

acrylic acid

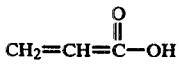

diacetone acrylamide

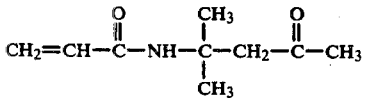

Exemplary compounds of the Formula when n is 1 and m is zero include:

alpha-thiophene aldehyde

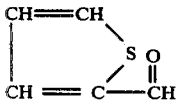

-continued furfural

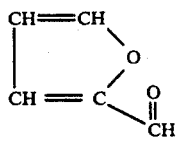

2-furyl methyl ketone

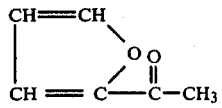

Exemplary compounds when n is zero and m is 1 include:

isophorone

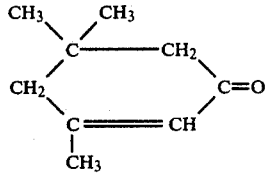

2-cyclopentenone

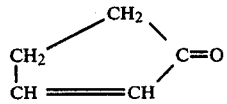

The second brightener combination found to provide the aforementioned characteristics contains a ring-halogenated aryl aldehyde, at least one compound of Formula:

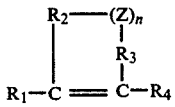

II wherein n, $R_1$, $R_2$ and $R_3$ are as defined above and $R_4$ is a carboxamido or carboxy group, and at least one compound of Formula II wherein $R_4$ is a formyl or alkyl carbonyl group. Either $R_1$ or $R_2$ must be a lower alkyl group in the latter compound. (It should be noted that in this instance diacetone acrylamide functions as a ketone as opposed to an amide.)

The concentration of the ring-halogenated aryl aldehyde may typically range from about 0.01 to about 0.5 gram per liter, with from about 0.03 to about 0.3 gram per liter being preferred. The concentration of formaldehyde (as 37 percent by weight formaldehyde in an aqueous solution) may range from about 2 to about 30 milliliters per liter with about 4 to about 15 milliliters per liter being preferred. Concentration of compounds depicted by Formula I or Formula II may range from about 0.1 to about 2.0 grams per liter with from about 0.15 to about 1.0 gram per liter being preferred.

Brightener concentrations below those recommended above may produce no plating at all or may tend to produce frostiness, dullness, non-uniformity or roughness in the deposit. Concentrations exceeding the upper limit are wasteful, may tend to cause insolubility of the brighteners in the bath, and may tend to produce thin or even non-existent deposit at low current density areas, i.e. below about 1.0 amperes per square decimeter.

Although it has been generally determined that the bath of the present invention characteristically functions without necessity of additional additives therein, such may desirably be included to modify the operation of the present bath. Additives such as pyrocatechol, resorcinol, beta-naphthol, and cresylic acid, as are reported useful as antioxidants in the literature relating to acid tin baths may typically be included.

The electroplating bath of the present invention may characteristically be operated over a wide range of plating conditions, and more particularly at temperatures ranging from about 60° F. (16° C.) to about 90° F. (32° C.) with from about 68° F. (20° C.) to 85° F. (30° C.) being preferred, and at cathode current densities of from about 0.02 to 25 amperes per square decimeter.

The invention will now be more specifically illustrated by the use of the following non-limiting examples wherein all parts are by weight unless otherwise indicated. In each of the baths of the following examples, unless otherwise noted, testing thereof was undertaken utilizing a conventional 267 milliliter Hull cell under 3 amperes of current for 3 minutes. Furthermore, the bath was not agitated and temperatures were maintained at from 22° C. to 24° C. therein. The examples were prepared utilizing a stock solution of 30 grams per liter of stannous sulfate and 105 milliliters per liter of 66° Baume sulfuric acid unless otherwise indicated.

EXAMPLE 1

A bath was prepared utilizing the aforementioned stock solution and, on a per liter basis, 10 grams of Amidox C-5 (tradename for a polyethoxylated, coconut fatty acid monoethanolamide), 7.5 milliliters of 37 percent by weight aqueous formaldehyde and 0.4 gram of mesityl oxide were added thereto. Testing in the Hull cell indicated a dull plate from 0.01 to 0.2 amperes per square decimeter, a semi bright plate from 0.2 to 1.5 amperes per square decimeter, a dull band was visible from 1.5 to 2.5 amperes per square decimeter, the panel was semi bright from 2.5 to 8.0 amperes per square decimeter and was fully bright at densities greater than 8.0 amperes per square decimeter.

To the above bath was added 0.15 gram per liter of 2,4-dichlorobenzaldehyde. The Hull cell panel indicated a fully bright deposit over the entire density range of from 0.01 to 15.0 amperes per square decimeter.

EXAMPLE 2

A bath was prepared utilizing the stock solution, and adding thereto on a per liter basis, 10 grams of Amidox C-5, 7.5 milliliters of 37 percent by weight aqueous formaldehyde and 0.15 gram of 2,4-dichlorobenzaldehyde. The Hull cell panel indicated a dull and thin plating from 0.01 to 0.15 amperes per square decimeter, frostiness was noted at from 0.15 to 3.5 amperes per square decimeter, a bright plate with some striation or streaking was noted from 3.5 to 7.0 amperes per square decimeter and at densities greater than 7.0 amperes per square decimeter, the plate was gray and appeared burned.

To the above bath was added 0.4 gram per liter of mesityl oxide whereupon a panel similar to that disclosed in Example 1 was provided.

EXAMPLE 3

A bath was prepared utilizing the stock solution, and on a per liter basis were added thereto 10 grams of Amidox C-5, 0.15 gram of 2,4-dichlorobenzaldehyde, and 0.4 gram of mesityl oxide. From 0.01 to 2.5 amperes per square decimeter the plate was very thin or nonexistent. At densities greater than 2.5 amperes per square decimeter, a thin, rough, black deposit appeared on the test panel.

When 7.5 milliliters of the 37 percent by weight formaldehyde was added to the bath, and retested, a fully bright panel was obtained as in the second solution of Example 1.

The above examples illustrate that the specific organic brightener combination, together with the nonionic surfactant provide a bright, desirable and commercially usable electroplated tin deposit.

EXAMPLE 4

To the basic stock solution were added, per liter, 10 grams of Amidox C-5, 0.15 gram of 2,4-dichlorobenzaldehyde, 7.5 milliliters of 37 percent by weight formaldehyde and 0.16 gram of alpha-thiophene aldehyde. The Hull test panel provided a bright deposit from 0.05 to 4.0 amperes per square decimeter with some pitting noted at densities greater than 1.8 amperes per square decimeter. From 4.0 to 12.0 amperes per square decimeter, the panel illustrated a bright plating with some pitting and striation noted.

EXAMPLE 5

An electroplating bath was prepared utilizing the stock solution in conjunction with, on a per liter basis, 10 grams of Amidox C-5, 0.15 gram of 2,4-dichlorobenzaldehyde, 7.5 milliliters of 37 percent by weight formaldehyde and 0.3 gram of 2-furyl methyl ketone. The Hull panel had a bright plate thereon from 0.05 to 6.0 amperes per square decimeter with some pitting noted at densities greater than 2.4 amperes per square decimeter, and was fully bright with some striation and pitting noted at from 6.0 to 12.0 amperes per square decimeter.

EXAMPLE 6

When the 2-furyl methyl ketone of Example 5 was replaced by 0.5 grams of diacetone acrylamide, a panel which was fully bright from 0.05 to 12.0 amperes per square decimeter was obtained.

EXAMPLE 7

When the ketone of Example 5 was replaced by 0.3 gram of acrylic acid, a test panel which was fully bright was obtained at current densities from 0.05 to 1.2 amperes per square decimeter, and from 1.2 to 12.0 amperes per square decimeter the plate was fully bright with some striation noted and some pitting was observed at densities greater than 2.0 amperes per square decimeter.

EXAMPLE 8

A bath was prepared utilizing the stock solution in conjunction with, on a per liter basis, 10 grams of Neutronyx 656 (tradename for an ethoxylated nonyl phenol), 8 milliliters of 37 percent by weight formaldehyde and 0.4 gram of mesityl oxide. At current densities of from 0.05 to 3.0 amperes per square decimeter, the plate was dull, and up to 12.0 amperes per square decimeter was semi bright.

To this solution was added 0.15 gram of 2,4-dichlorobenzaldehyde whereupon a fully bright panel was obtained from 0.01 to 15.0 amperes per square decimeter with some pitting being noted at densities greater than 5.0 amperes per square decimeter.

EXAMPLE 9

To the stock solution was added, on a per liter basis, 2 grams of Neutronyx 656, 8 milliliters of 37 percent by weight formaldehyde and 0.03 gram of parachlorobenzaldehyde. The Hull test panel indicated nonexistent or a very thin bright plate at densities of from 0.01 to 1.2 amperes per square decimeter and frostiness was noted at current densities greater than 1.2 amperes per square decimeter.

An additional 8 grams of Neutronyx 656 was added to the bath whereupon the panel provided bright plating with some haziness from 0.01 to 1.2 amperes per square decimeter, frostiness at densities of from 1.2 to 3.5 amperes per square decimeter, a bright panel with some striation and pitting from 3.5 to 8.0 amperes per squre decimeter and burning of the panel at densities greater than 8.0 amperes per square decimeter.

To this solution was added 0.3 gram per liter of mesityl oxide whereupon the test panel provided a bright plate from 0.05 to 15.0 amperes per square decimeter, some pitting being noted at densities greater than 6.0 amperes per square decimeter.

EXAMPLE 10

A bath was prepared utilizing the stock solution in conjunction with, on a per liter basis, 10.0 grams of Amidox C-5, 0.15 grams of 2,4-dichlorobenzaldehyde, 0.3 gram of mesityl oxide and 0.15 gram of acylic acid. The test panel was fully bright over a current density range of from 0.1 to 12.0 amperes per square decimeter.

EXAMPLE 11

A bath was prepared utilizing the stock solution in conjunction with, on a per liter basis, 10.0 grams of Amidox C-5, 0.15 gram of 2,4-dichlorobenzaldehyde, 0.4 gram of diacetone acrylamide and 0.15 gram of acrylic acid. The test panel was fully bright over a current density range of from 0.05 to 15.0 amperes per square decimeter.

EXAMPLE 12

A bath was prepared by mixing, on a per liter basis, 45 milliliters of a 49.6 percent by weight aqueous stannous fluoborate solution, 140 milliliters of a 49 percent by weight aqueous fluoboric acid, 4 grams of Amidox C-5, 0.15 grams of 2,4-dichlorobenzaldehyde and 7.5 milliliters of 37 percent by weight formaldehyde. The test panel provided a very thin, or in some instances, nonexistent plating at current densities of from 0.01 to 0.2 amperes per square decimeter, a frosty plate at from 0.2 to 8.0 amperes per square decimeter, and a fully bright plate with some striation and pitting noted at from 8.0 to 12.0 amperes per square decimeter.

To this solution was added 0.45 gram of mesityl oxide whereupon the test panel illustrated a relatively thin plate at current densities of from 0.01 to 0.15 amperes per square decimeter and a fully bright plate from 0.15 to 12.0 amperes per square decimeter with some pitting noted at densities greater than 6.0.

EXAMPLE 13

A bath was prepared by combining, on a per liter basis, 90 milliliters of a 49.6 percent by weight aqueous stannous fluoborate solution, 140 milliliters of 49 percent by weight aqueous fluoboric acid, 10.0 grams of Amidox C-5, 0.15 gram of 2,4-dichlorobenzaldehyde, 0.6 gram of mesityl oxide and 15 milliliters of 37 percent by weight aqueous formaldehyde. A Hull cell panel tested under 5 amperes of current for 2 minutes with fast agitation indicated a brightness range over from 2.0 to 23.0 amperes per square decimeter with some pitting of the plate being noted at densities above 12.5 amperes per square decimeter.

EXAMPLE 14

An electroplating bath was prepared by combining, on a per liter basis, 25.7 grams of cadmium oxide, 15 grams of stannous sulfate, 105 milliliters of 66° Baume sulfuric acid, 12.0 grams of Amidox C-5, 0.15 gram of 2,4-dichlorobenzaldehyde and 7.5 milliliters of 37 percent by weight aqueous formaldehyde. A Hull test panel indicated a frosty plate at current densities of from 0.01 to 3.0 amperes per square decimeter with the plating being fully bright with heavy pitting noted at densities of from 3.0 to 15.0 amperes per square decimeter.

To this solution was added 0.22 gram per liter of mesityl oxide. The test panel indicated a fully bright range over densities of from 0.05 to 15.0 amperes per square decimeter.

What we claim is:

1. An aqueous acid plating bath for the electrodeposition of bright tin and tin/cadmium alloys comprising about 7.5 to 75 grams per liter of a metal ion selected from the group consisting of stannous ion, cadmium ion and mixtures thereof; about 70 to 400 grams per liter of a free acid selected from the group consisting of fluoboric acid, sulfuric acid and mixtures thereof; about 3 to 30 grams per liter of a non-ionic polyoxyalkylated surfactant; and a brightener combination consisting of about 0.01 to 0.5 grams per liter of a ring-halogenated aryl aldehyde, about 2 to 30 milliliters per liter of a 37 percent by weight aqueous formaldehyde solution; and about 0.1 to 2.0 grams per liter of at least one compound of the formula:

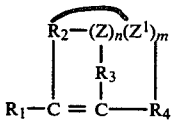

where n is zero or 1, m is zero or 1, and when n is 1, m is zero, and when m is 1, n is zero, $R_1$ is hydrogen or a lower alkyl group, and when n and m are zero, $R_2$ and $R_3$ are hydrogen or lower alkyl groups, and $R_4$ is a formyl, alkyl carbonyl, carboxamido or carboxy group or mixtures thereof, and when $R_4$ is a formyl or alkyl carbonyl group or mixture thereof, $R_1$ or $R_2$ is a lower alkyl group; when n is 1, the combination of $R_2$ and Z represent ethylene, $R_3$ is an oxygen or sulfur radical, and $R_4$ is a formyl, alkyl carbonyl, carboxamido or carboxy group or mixture thereof; when m is 1, the combination of $R_2$ and $Z^1$ represent alkylene, $R_3$ is hydrogen or a lower alkyl group and $R_4$ is a carbonyl group.

2. The bath of claim 1 wherein said compound is selected from the group consisting of mesityl oxide, crotonaldehyde, acrylic acid, diacetone acrylamide, alphathiophene aldehyde, furfural, 2-furyl methyl ketone, isophorone and 2-cyclopentenone.

3. The bath of claim 1 wherein said surfactant is selected from the group consisting of polyethoxylated fatty acid monoalkylolamides and polyethoxylated alkyl phenols.

4. An aqueous acidic bath for the electrodeposition of tin and tin/cadmium alloys comprising from 7.5 to 75 grams per liter of a metallic ion selected from the group consisting of stannous ion, cadmium ion and mixtures thereof; about 70 to 400 grams per liter of a free acid selected from the group consisting of fluoboric acid, sulfuric acid and mixtures thereof; about 3 to 30 grams per liter of a non-ionic polyoxyalkylated surfactant; and a brightener combination consisting of about 0.01 to 0.5 gram per liter of a ring-halogenated aryl aldehyde; about 0.1 to 2.0 grams per liter of a first compound of the formula:

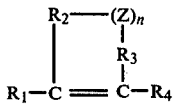

wherein n is zero or 1, $R_1$ is hydrogen or a lower alkyl group; and when n is zero, $R_2$ and $R_3$ are hydrogen or a lower alkyl group, wherein $R_1$ or $R_2$ is a lower alkyl group and $R_4$ is a formyl or alkyl carbonyl group or mixtures thereof; and when n is 1, the combination of $R_2$ and Z represent ethenylene, $R_3$ is an oxygen or sulfur radical and $R_4$ is a formyl or alkyl carbonyl group or mixture thereof; and about 0.1 to about 2.0 grams per liter of a second compound of the formula:

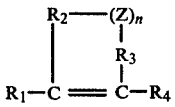

wherein n is zero or 1, $R_1$ is hydrogen or a lower alkyl group; and when n is zero, $R_2$ and $R_3$ are hydrogen or a lower alkyl group, and where $R_4$ is a carboxy or carboxamido group or mixture thereof; and when n is 1, the combination of $R_2$ and Z represent ethenylene, $R_3$ is an oxygen or sulfur radical, and $R_4$ is a carboxy or carboxamido group or mixture thereof.

5. The bath of claim 4 wherein said first compound is selected from the group consisting of mesityl oxide, crotonaldehyde, diacetone acrylamide, alpha-thiophene aldehyde, furfural, 2-furyl methyl ketone and said second compound is acrylic acid.

6. The bath of claim 4 wherein said surfactant is selected from the group consisting of polyethoxylated fatty acid monoalkylolamides and polyethoxylated alkyl phenols.

* * * * *